US005425159A

United States Patent [19]

Klüttermann et al.

[11] Patent Number: 5,425,159

[45] Date of Patent: Jun. 20, 1995

[54] BATTERY REPLACING APPARATUS FOR A COILER CAN CARRIAGE

[75] Inventors: Jürgen Klüttermann; Igor Lamprecht, both of Mönchengladbach, Germany

[73] Assignee: Trützschler GmbH & Co. KG, Mönchengladbach, Germany

[21] Appl. No.: 168,376

[22] Filed: Dec. 17, 1993

[30] Foreign Application Priority Data

Dec. 17, 1992 [DE] Germany ..... 42 42 659.6

[51] Int. Cl.[6] ..... D01H 9/18; H01M 10/44

[52] U.S. Cl. ..... 19/159 A; 104/34

[58] Field of Search ..... 19/159 A; 414/223, 395, 414/400; 191/4, 16, 10; 180/68.5; 104/34; 901/1

[56] References Cited

U.S. PATENT DOCUMENTS

| | | | |
|---|---|---|---|
| 3,259,365 | 7/1966 | Gibson | 104/34 X |
| 3,529,229 | 9/1970 | Kennedy | 320/2 |
| 3,799,063 | 3/1974 | Reed | 104/34 |
| 4,283,164 | 8/1981 | Reaney | 414/400 X |
| 4,450,400 | 5/1984 | Gwyn | 104/34 X |
| 4,683,619 | 8/1987 | Langen et al. | 19/159 A |
| 4,694,539 | 9/1987 | Langen | 19/159 A |
| 5,091,687 | 2/1992 | Meyer et al. | 104/34 X |
| 5,187,423 | 2/1993 | Marton | 104/34 X |
| 5,311,973 | 5/1994 | Tseng et al. | 191/10 |

FOREIGN PATENT DOCUMENTS

| | | | |
|---|---|---|---|
| 0090383 | 5/1922 | Germany | 104/34 |
| 2114962 | 8/1972 | Germany . | |
| 2444711 | 4/1976 | Germany . | |
| 2629101 | 1/1977 | Germany . | |
| 3621370 | 3/1987 | Germany . | |
| 8525743 | 4/1987 | Germany . | |
| 3628154 | 2/1988 | Germany . | |
| 3923011 | 1/1990 | Germany . | |
| 4110159 | 10/1991 | Germany . | |

OTHER PUBLICATIONS

"Canny Four", Inovatex, Engineering-Team, Transportation-and-Storage-System, Nov. 1987, 4 pages.

"Versuche mit Elektrofahrzeugen", ETZ-B bd. 23 (1971) vol. 9, pp. 212, 213.

"Erste batterie-elektrischie Buslinie der Welt in Betrieb", Verkehr und Technik, 1974, vol. 11, pp. 448, 449.

Preuss, "Antriebsbatterien und Ladeverfarhen für den Einsatz fahrerloser Förderzeuge", VARTA spezial report, Feb. 1984, pp. 1341-1356.

*Primary Examiner*—Clifford D. Crowder
*Assistant Examiner*—Ismael Izaguirre
*Attorney, Agent, or Firm*—Spencer, Frank & Schneider

[57] ABSTRACT

A system for conveying a coiler can between a sliver producing fiber processing machine and a sliver consuming fiber processing machine includes a carriage for accommodating the coiler can; an electric motor mounted on the carriage for propelling the carriage; and a battery replaceably mounted on the carriage and being electrically connected with the motor for supplying electric current thereto. The system further includes a battery replacing apparatus having a manipulating mechanism for removing a battery from and for moving a battery onto the carriage and a supporting arrangement for supporting the battery during displacement thereof by the manipulating mechanism.

16 Claims, 8 Drawing Sheets

BATTERY REPLACING APPARATUS FOR A COILER CAN CARRIAGE

CROSS REFERENCE TO RELATED APPLICATION

This application claims the priority of German Application No. P 42 42 659.6 filed Dec. 17, 1992, which is incorporated herein by reference.

BACKGROUND OF THE INVENTION

This invention relates to a system for transporting a coiler can between a sliver producing fiber processing machine, such as a carding machine and a sliver consuming fiber processing machine such as a drafting frame. The system includes a carriage which accommodates the coiler can and on which an electromotor is mounted for propelling the carriage. The electromotor is supplied with electric current by a battery mounted on the carriage.

In a conventional system of the above-outlined type a lead battery is used which, when low, has to be replaced for recharging. The recharging operation lasts approximately between eight to twelve hours. Particularly in case of around-the-clock work shifts (uninterrupted operation) problems are encountered as concerns the effective time (working time, travelling time and preparation time) of the carriage. In case no skilled personnel is available for carrying out the battery replacement, for example, during the night shift when fully automatic operation is in effect and, for example, only a single monitoring person is present, the carriage remains idle for the remainder of the shift whereby loss periods in the production are experienced. Even if skilled personnel for carrying out the battery replacement is available, for example, during the day shift, undesired lost periods occur by the fact that such personnel cannot always perform the job immediately. Thus, the carriage is idle until such personnel arrives, whereby the useful time period is reduced.

SUMMARY OF THE INVENTION

It is an object of the invention to provide an improved system of the above-outlined type from which the discussed disadvantages are eliminated and which, in particular, may be utilized in an around-the-clock operation with a high useful time proportion.

This object and others to become apparent as the specification progresses, are accomplished by the invention, according to which, briefly stated, the system for conveying a coiler can between a sliver producing fiber processing machine and a sliver consuming fiber processing machine includes a carriage for accommodating the coiler can; an electric motor mounted on the carriage for propelling the carriage; and a battery replaceably mounted on the carriage and being electrically connected with the motor for supplying electric current thereto. The system further includes a battery replacing apparatus having a manipulating mechanism for removing a battery from and for moving a battery onto the carriage and a supporting arrangement for supporting the battery during displacement thereof by the manipulating mechanism.

By virtue of the measures according to the invention it is feasible to utilize the carriage in a multi-shift (for example, three-shift) operation with a high useful time proportion. With the aid of the automatic battery replacing apparatus an exchange of an exhausted battery with a charged battery is feasible during any working shift without skilled personnel. Thus, after battery replacement the carriage may be continuously utilized for the remainder of the shift whereby production losses are avoided. Even if skilled personnel is available in a certain working shift, the device according to the invention makes it possible to carry out the battery replacement at any time; that is, periods for waiting for the skilled personnel are eliminated. Thus, by virtue of the rapid battery replacement the useful time proportion in a multi-shift operation is significantly improved. Further, the automatic battery replacing apparatus improves the operational reliability.

The invention has the following additional advantageous features:

The manipulating mechanism moves the battery automatically from or, respectively, onto the carriage.

The battery replacing apparatus is associated with a battery charging apparatus.

The battery replacing apparatus may be movable between the carriage and the battery storage emplacements of the battery charging apparatus.

The battery replacing apparatus includes a propellable cart or the like.

The manipulating mechanism has a grasping element provided with a carrier element, and the manipulating mechanism may be brought into engagement with a battery locking device.

On the battery a current rail is arranged which may be sequentially contacted by a current pickup element mounted on the carriage and a current supply element mounted on the battery charger.

The current pickup element and the current supply element are of identical structure.

The current pickup element and/or the current supply element are resiliently supported.

The contacting face of the current rail and the contacting face of the current pickup element and the current supply element are in an overlapping relationship.

With the battery of the transport carriage there is associated a microcomputer for monitoring the state of the battery charge. The microcomputer emits a signal when the battery is low. The signal is utilized for controlling the displacement of the carriage to the battery replacing and charging apparatus or the battery charging apparatus is called to the carriage by the signal.

DESCRIPTION OF THE PREFERRED EMBODIMENTS

Figure 1:
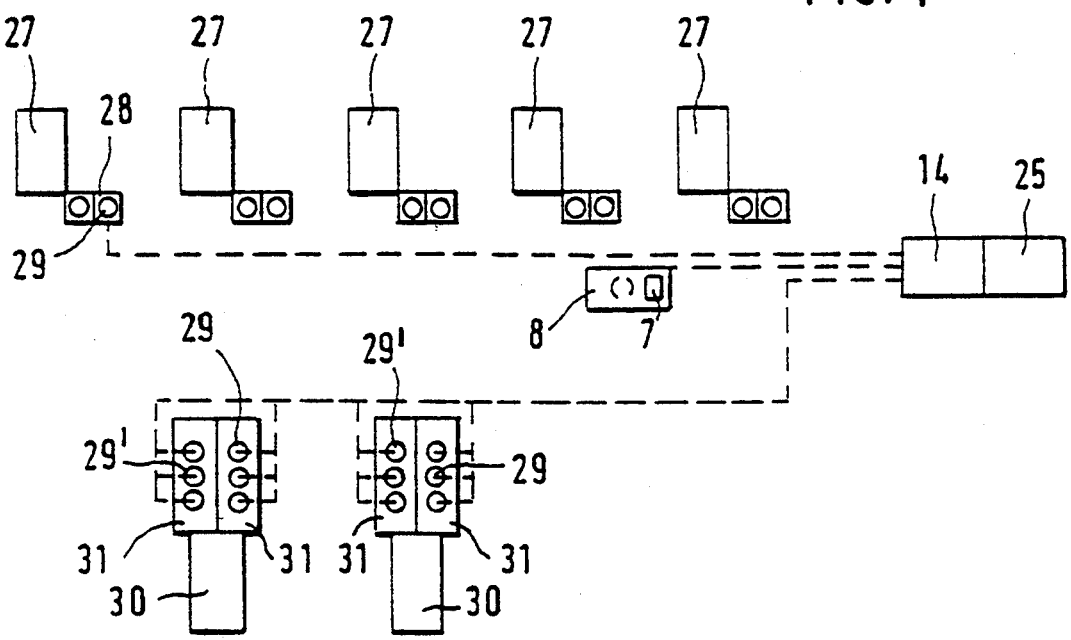
FIG. 1 is a schematic top plan view of a spinning preparation system including five carding machines, two drafting frames, a coiler can transporting carriage and a battery replacing and charging apparatus according to the invention.
Figure 2:
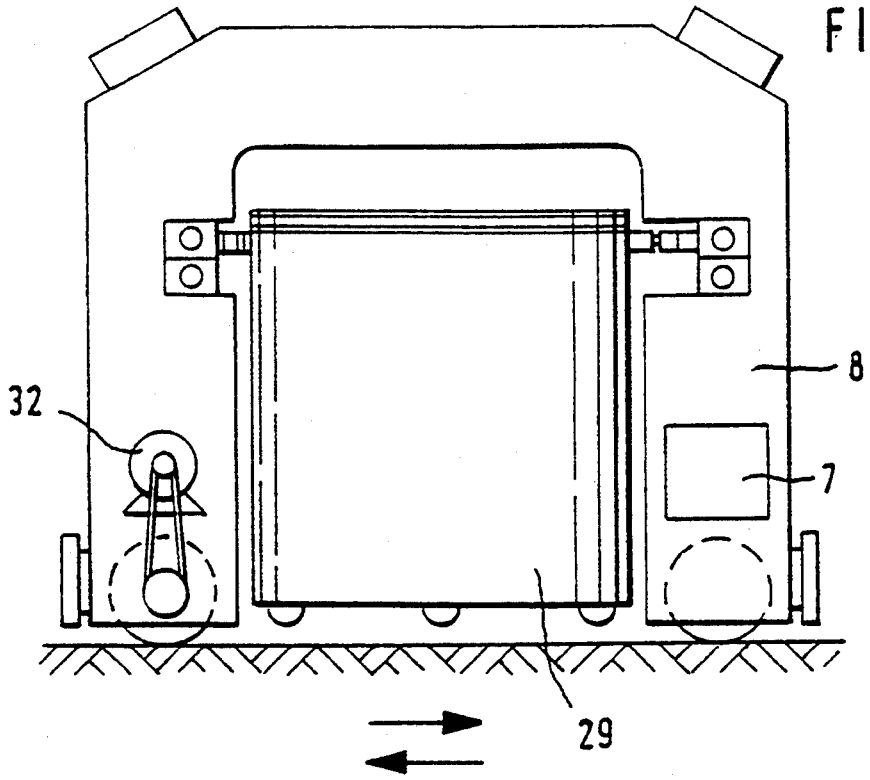
FIG. 2 is a side elevational view of a coiler can transporting carriage accommodating a coiler can and carrying a drive motor as well as a battery.

The system for the spinning preparation illustrated in FIG. 1 comprises five carding machines 27 and two drafting frames 30. With the carding machines 27 coiler can changers 28 are associated which accommodate coiler cans 29. With the drafting frames 30 standby stations 31 are associated, each accommodating filled coiler cans 29'. Also referring to FIG. 2, the transportation of the cans 29' filled by the carding machines 27 is effected by a carriage 8 which is propelled by an electromotor 32 supplied by a battery 7, both mounted on the carriage 8.

Figure 3:
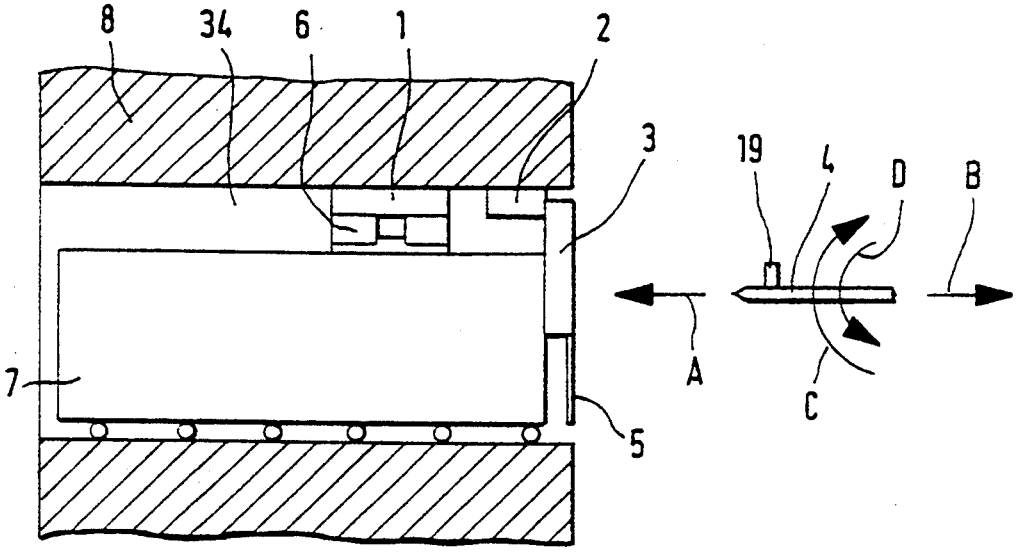
FIG. 3 is a fragmentary sectional side elevational view of a part of FIG. 2 on an enlarged scale.

Turning to FIG. 3, the battery 7 is accommodated in a battery chamber 34 which forms part of the carriage 8 and which is closed outwardly by a cover plate 5. When the battery is in its inserted position as shown in FIG. 3, a current pickup contact 1, electrically connected with the motor 32 in a non-illustrated manner, is in engagement with a battery terminal 6. An adaptor 3, affixed to the battery housing, engages a battery lock 2 which is affixed to the wall of the battery chamber 34 and which secures, in cooperation with the adaptor 3, the battery 7 in its position.

Figure 5:
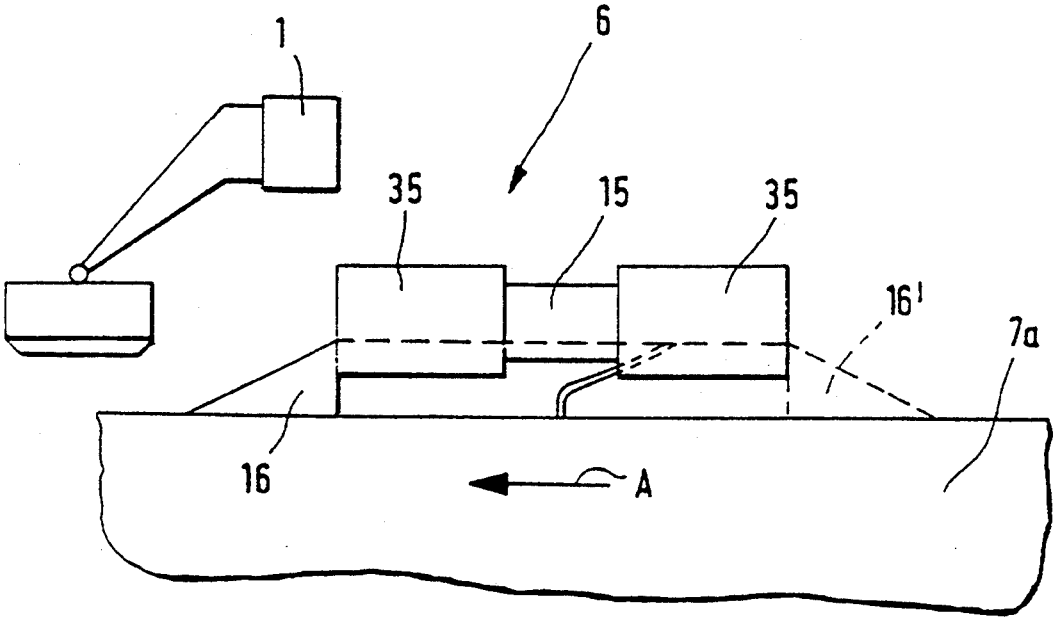
FIG. 5 is a schematic side elevational detail, on an enlarged scale, of the construction shown in FIG. 4.

In FIG. 5 the battery terminal 6 is shown in detail. In this construction, on the battery casing 7*a* between the end pieces 35 a current carrying rail 15 is positioned which is flanked by sloped run-in ramps 16 and 16'.

Figure 4:
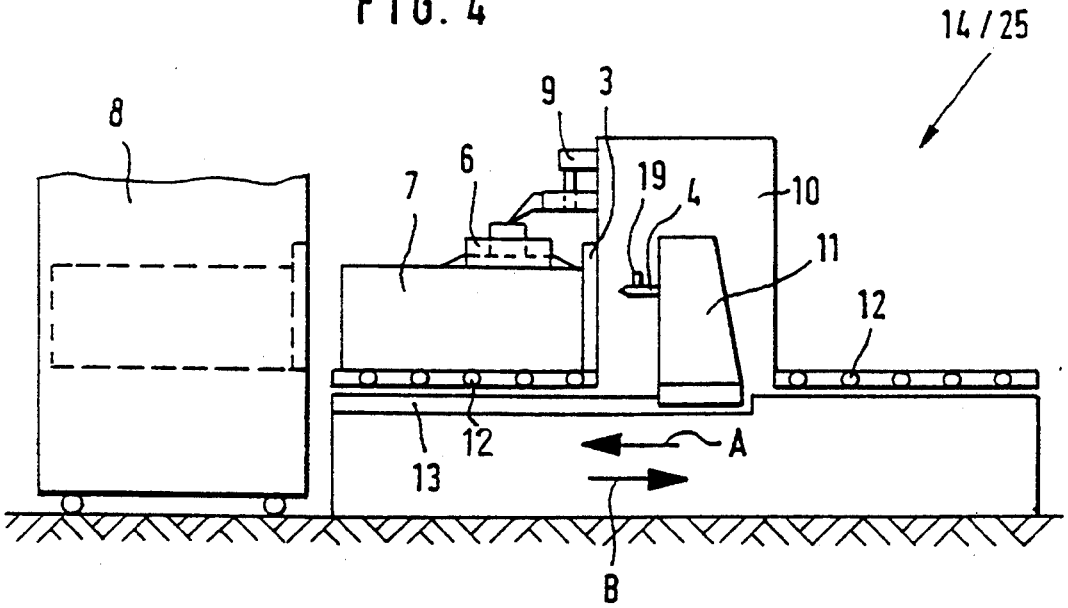
FIG. 4 is a schematic side elevational view of a combined battery replacing apparatus and battery charging apparatus.

Turning to FIG. 4, there is schematically illustrated the combination of a battery replacing apparatus 14 and a charging apparatus 25 designed as a stationary aggregate. A manipulator 11 may move on a track 13 in either direction as indicated by the arrows A and B. The manipulator 11 has an arm 4 on which there is mounted a battery engaging pin 19. By pushing the arm 4 into the adaptor 3 and rotating it in the clockwise direction C as shown in FIG. 3, the pin 19 locks the battery 7 to the manipulator 11. At the same time—if the battery 7 is still situated on the carriage 8—the battery lock 2 on the carriage 8 is released. By moving the manipulator 11 away from the carriage 8, that is, in the direction of the arrow B of FIG. 4, the battery 7 is pulled out of the battery chamber 34 and positioned onto the roller track 12. At the same time, the battery terminal 6, that is, the current rail 15 enters into engagement with the current supply terminal 9 of the battery charging apparatus 25. The upper part 10 is rotatably mounted.

Figure 6:
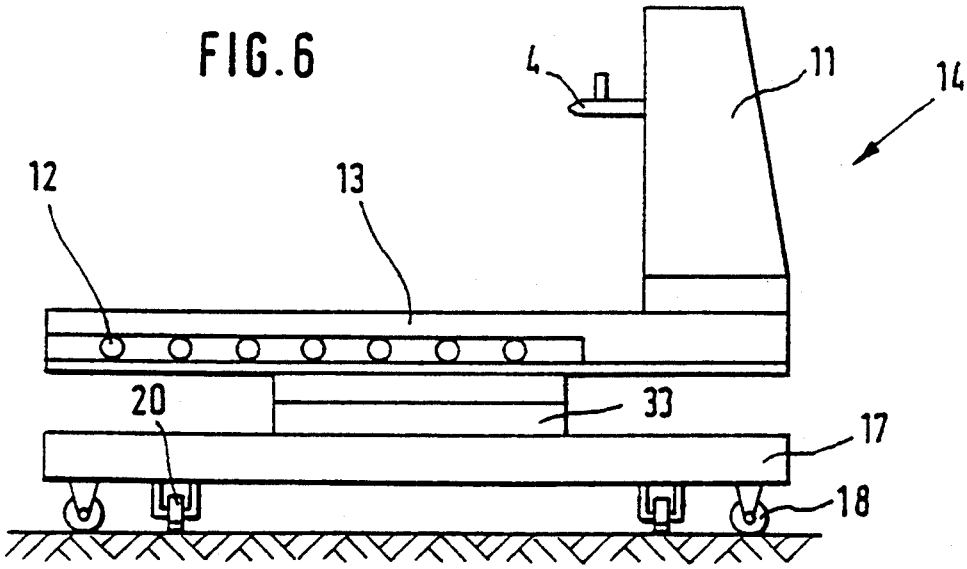
FIG. 6 is a schematic side elevational view of a propellable battery replacing apparatus.

FIG. 6 illustrates a propellable battery replacing apparatus 14. The roller track 12, together with the manipulator 11 displaceable on the rail 13 is supported on a platform 33 for rotation about a vertical axis. The platform 33 (which may be a ring gear assembly) is mounted on a cart 17 which, in turn, is provided with wheels 18 for a longitudinal travel and wheels 20 for a transverse travel.

Figure 7:
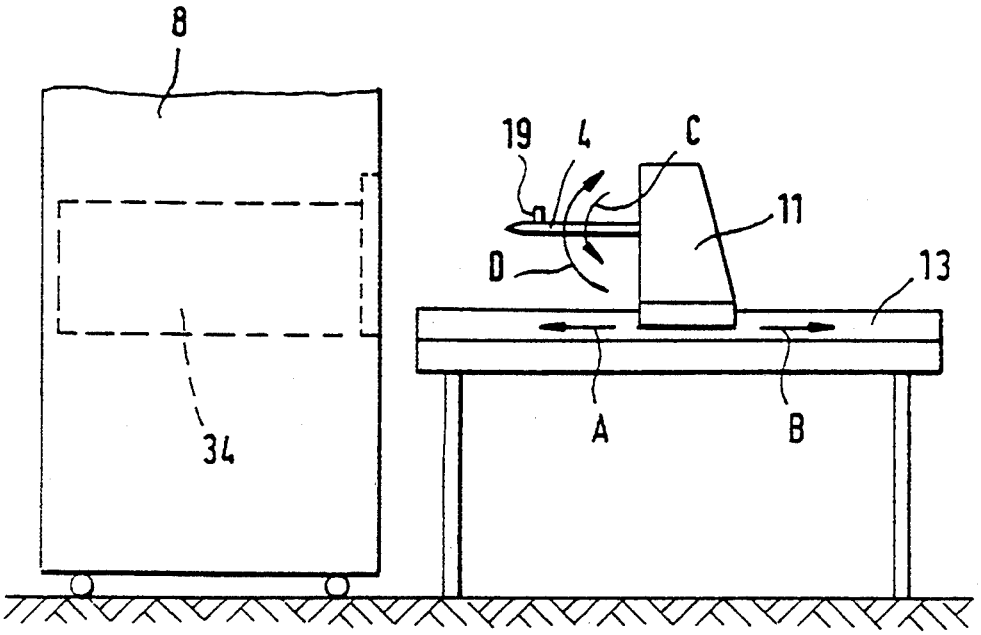
FIG. 7 is a schematic side elevational view of a further embodiment of a stationary battery replacing apparatus.
Figure 8:
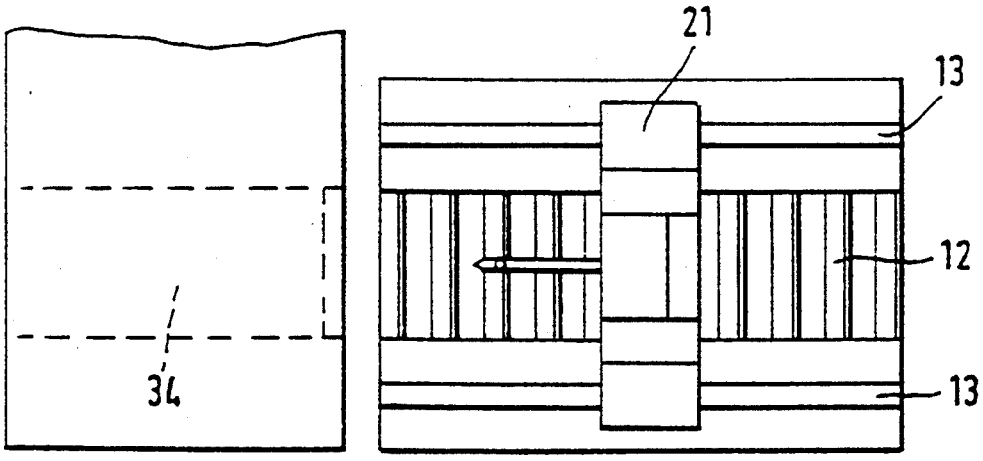
FIG. 8 is a schematic top plan view of the construction shown in FIG. 7.

FIGS. 7 and 8 show a further embodiment of the battery replacing apparatus. In this stationary aggregate, the rails 13 for the manipulator 11 are situated on either side of the roller track 12. The manipulator 11 is mounted on a sled 21 for displacement in the direction of arrows A or B. In this embodiment too, the battery engaging pin 19 may be rotated in the clockwise direction C or counterclockwise direction D by means of the arm 4.

Figure 9:
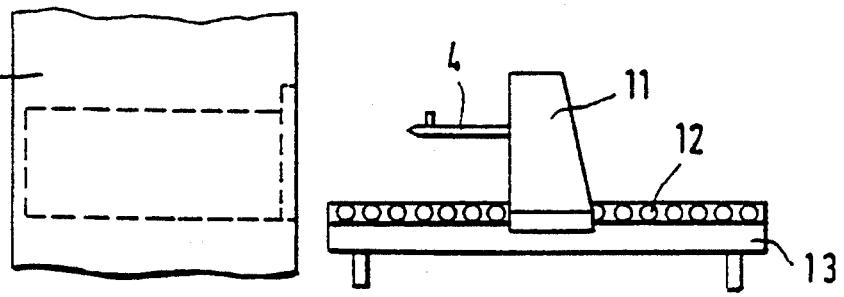
FIG. 9 is a schematic side elevational view of another embodiment of a stationary battery replacing apparatus.
Figure 10:
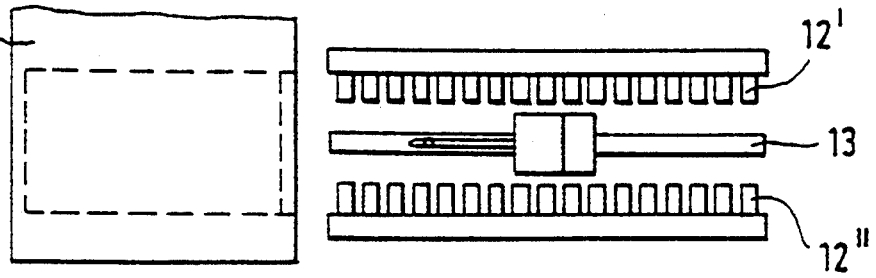
FIG. 10 is a schematic top plan view of the construction shown in FIG. 9.

In the embodiment shown in FIGS. 9 and 10 the manipulator 11 is guided on a single rail 13, whereas the roller track is divided into parallel roller track portions 12' and 12" which flank the single rail 13. The two roller track portions 12' and 12" support the battery 7 along opposite marginal zones of the underface thereof.

Figure 11:
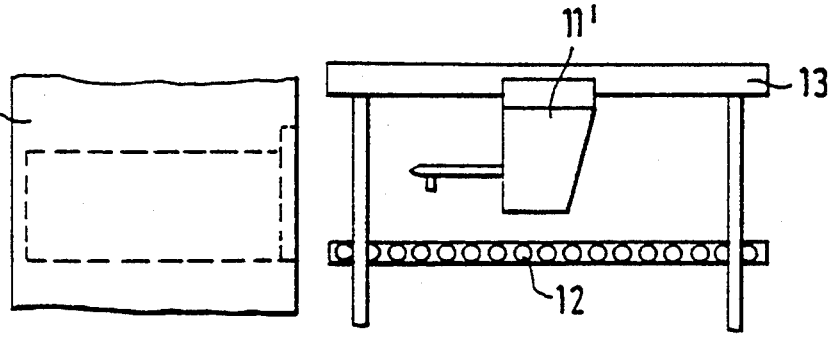
FIG. 11 is a schematic side elevational view of yet another embodiment of a stationary battery replacing apparatus.
Figure 12:
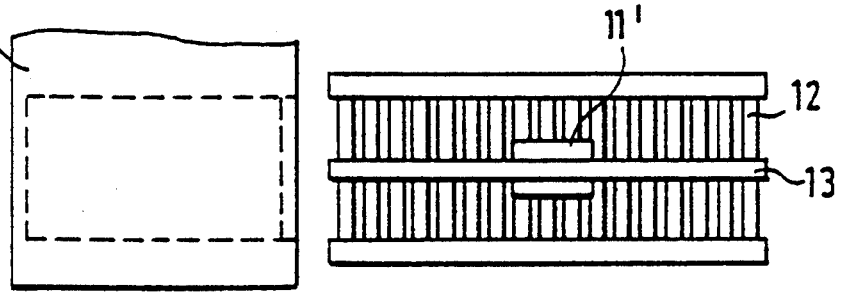
FIG. 12 is a schematic top plan view of the construction shown in FIG. 11.

In the embodiment shown in FIGS. 11 and 12 the battery replacing apparatus has a manipulator 11' which is suspended from the rail 13 and may travel above the roller track 12.

Figure 13:
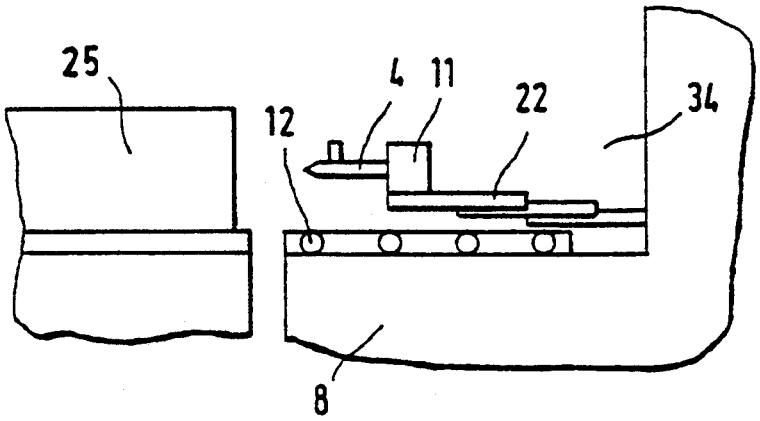
FIG. 13 is a schematic side elevational view of a battery replacing apparatus mounted on the coiler can transporting carriage.

In the embodiment according to FIG. 13 the manipulator 11 is mounted on telescoping arms 22 which are in turn mounted in the battery chamber 34 of the coiler can carriage 8.

Figure 14:
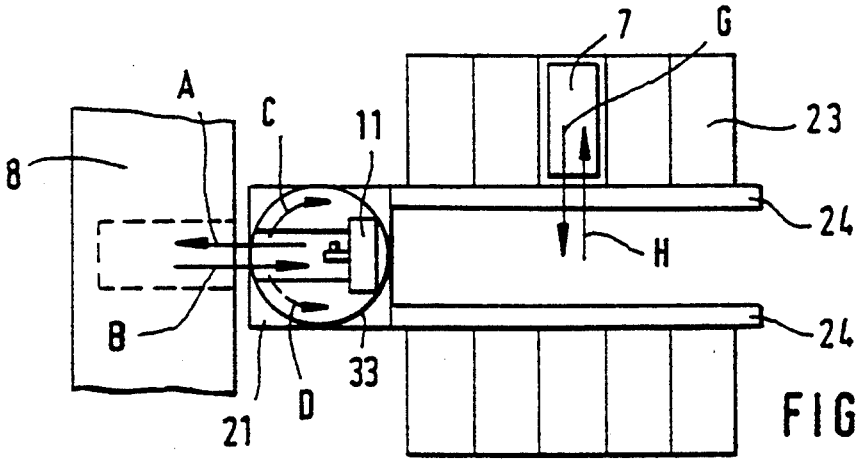
FIG. 14 is a schematic top plan view of a further embodiment of the invention illustrating a combined battery replacing and charging apparatus.

In the embodiment illustrated in FIG. 14, the stationary battery replacing apparatus has a rotary platform 33 which supports the manipulator 11. Upon appropriate rotation of the platform 33, the battery pulled by the manipulator 11 from the battery chamber 34 of the carriage 8 deposits the battery on a track 24 from which the battery is then introduced into one of the emplacements 23 of the battery charging apparatus. Similarly, a charged battery from an emplacement 23 is moved on the rails 24 to the manipulator 11 which then, after appropriate rotation by the platform 33, introduces the charged battery in the direction of the arrow A into the battery chamber 34 of the coiler can carriage 8. The electrical connection between the battery terminals 6 and the current supply terminal 9 is similar to that described in connection with FIG. 4.

Figure 15:
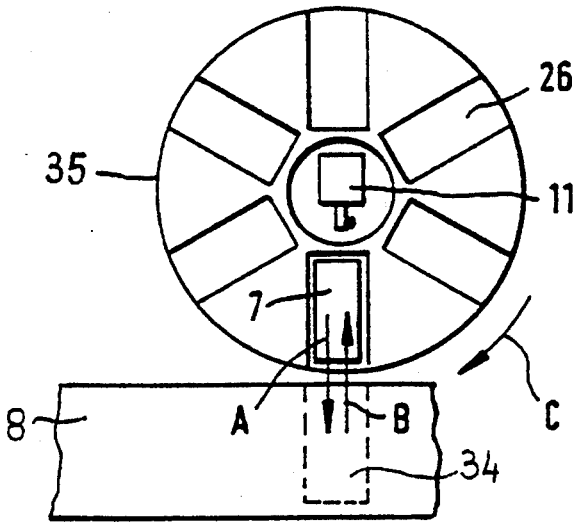
FIG. 15 is a top plan view of another embodiment of the invention illustrating a combined battery replacing and charging apparatus.

In the embodiment illustrated in FIG. 15, a circular platform 35 is provided which has compartments (emplacements) 26 arranged in a circular array about the centrally located manipulator 11. Placement of a battery from the carriage 8 into a compartment 26 or from a compartment 26 onto the carriage 8 is effected by the centrally located manipulator 11 out of or into a compartment 26 properly aligned with the battery chamber 34 of the carriage 8.

Figure 16:
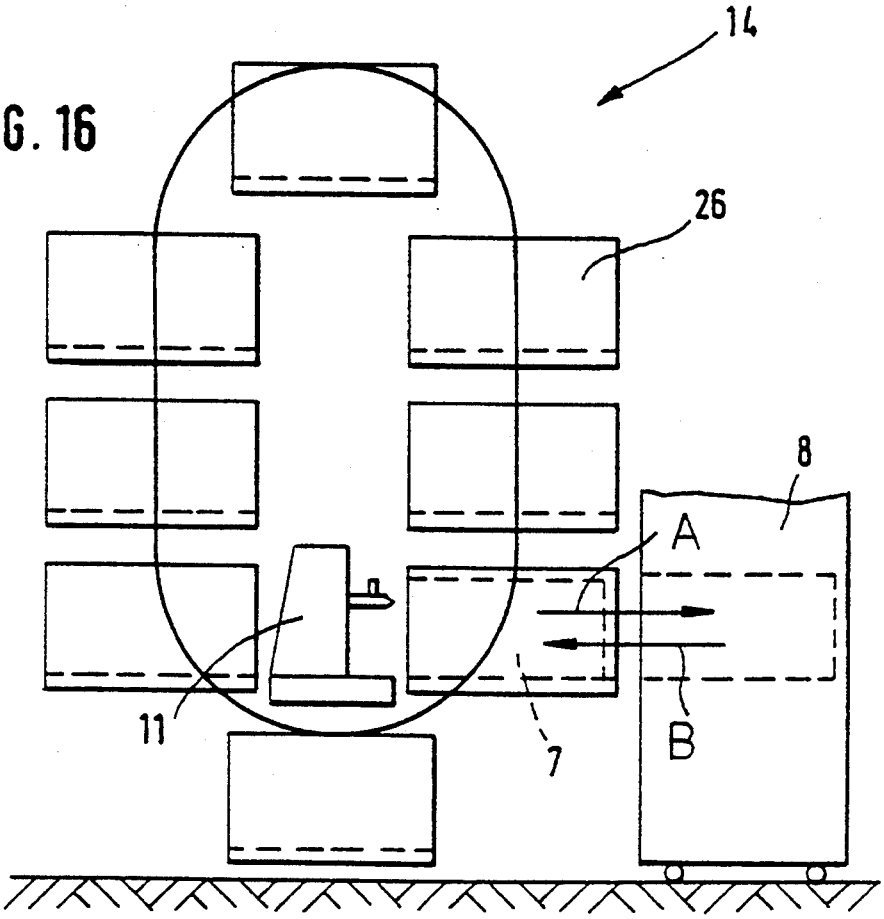
FIG. 16 is a schematic top plan view of still another embodiment of the invention illustrating a combined battery replacing and charging apparatus.

In FIG. 16 the battery replacing station is structured as a vertical continuous elevator ("paternoster" elevator) in which the individual gondolas 26 serve as emplacements for receiving individual batteries 7 which are positioned therein by the manipulator 11 in the direction of the arrow B or are positioned from the respective gondola 26 in the direction of the arrow A into the carriage 8.

Figure 17:
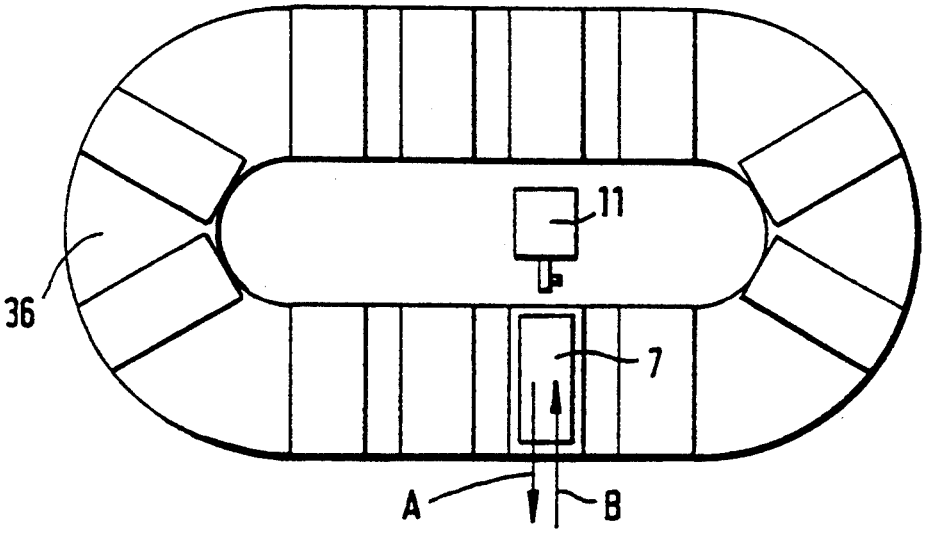
FIG. 17 is a schematic top plan view of yet another embodiment of the invention illustrating a combined battery replacing and charging apparatus.

In FIG. 17 the battery replacing apparatus includes a circulating segmented belt 36 onto which the manipulator 11 situated inside the loop formed by the belt 36, pulls the exhausted battery from the carriage 8 (not shown in FIG. 17) onto the belt 36 in the direction of the arrow B or pushes a charged battery into the battery chamber of the carriage 8 in the direction of the arrow A.

Figure 18:
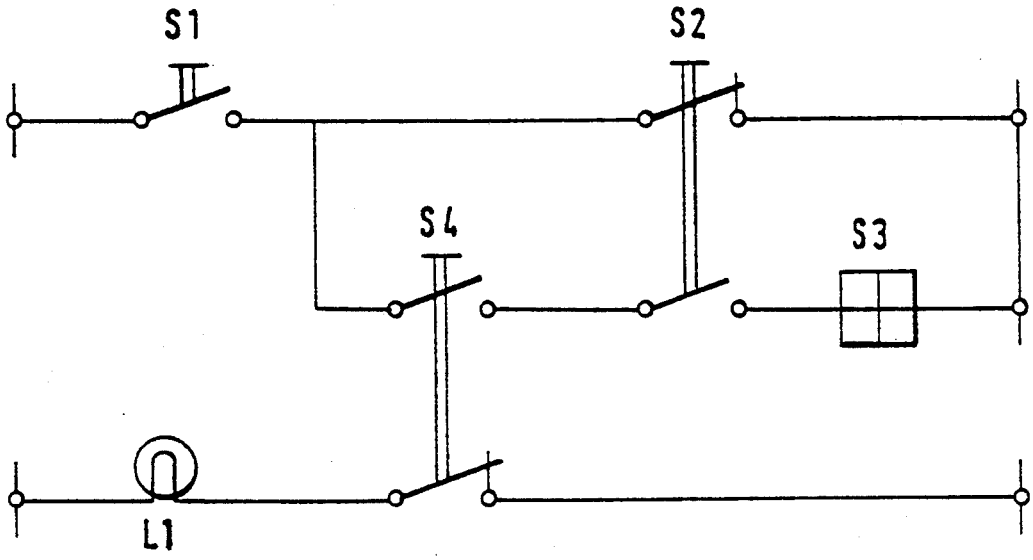
FIGS. 18 and 19 are diagrams of the battery charging circuits.

In FIG. 18 the charging circuit of the charging apparatus 25 is shown. It has, in principle, the same construction as the circuit in the battery chamber 34 of the carriage 8. The limit switch S1 is actuated when the battery arrives in the end position on the battery charging emplacement 23. The limit switch S2 is opened by rotating the manipulator 11. The switch S3 is locked by spring force and may be electromagnetically released. If the battery is in its end position and the manipulator 11 is no longer in engagement with the battery, that is, S1 is actuated and S2 is no longer actuated, the circuit is closed and thus the charging current may flow. For releasing the battery 7 the switch S2 has to be actuated and additionally the switch S4 has to be closed.

Figure 19:
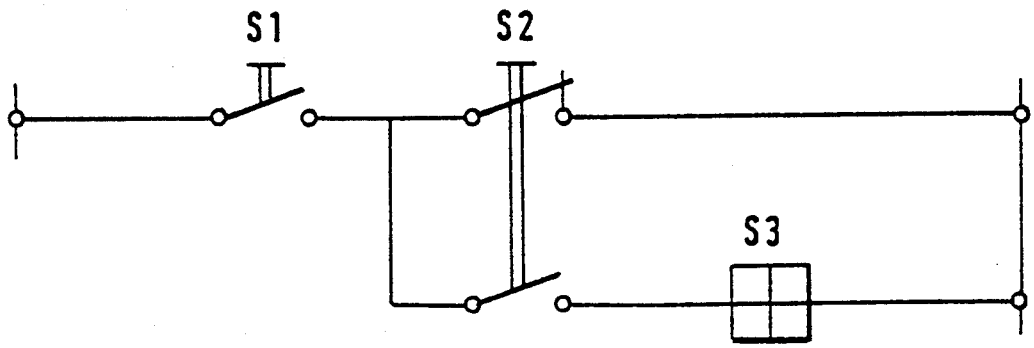

FIG. 19 illustrates a significantly simplified charging circuit, from which the safety measures of the circuit shown in FIG. 18 are omitted.

It will be understood that the above description of the present invention is susceptible to various modifications, changes and adaptations, and the same are intended to be comprehended within the meaning and range of equivalents of the appended claims.

What is claimed is:

1. In a system for conveying a coiler can between a sliver producing fiber processing machine and a sliver consuming fiber processing machine, including a carriage for accommodating the coiler can;

an electric motor mounted on said carriage for propelling said carriage; and a battery replaceably mounted on said carriage and being electrically connected with said motor for supplying electric current thereto;

the improvement comprising a battery replacing apparatus including manipulating means for automatically directly engaging and removing a battery from and moving a battery onto said carriage and support means for supporting the battery during displacement thereof by said manipulating means.

2. The system as defined in claim 1, further comprising means for defining a plurality of compartments each accommodating a battery; and means for providing for a displaceability of said battery replacing apparatus along said compartments for depositing a battery into or removing a battery from a selected said compartment.

3. The system as defined in claim 1, wherein said manipulating means comprises a manipulating element and a battery engaging element mounted on said manipulating element.

4. The system as defined in claim 3, wherein said manipulating element comprises a manipulating arm and said battery engaging element comprises a battery engaging pin extending at an angle from said manipulating arm.

5. The system as defined in claim 1, wherein said battery replacing apparatus comprises a displaceable cart; said manipulating means and said support means being mounted on said cart.

6. The system as defined in claim 5, further comprising track means for providing for a generally linear displacement of said manipulating means relative to said cart; said track means being supported on said cart.

7. The system as defined in claim 1, further comprising a battery charging apparatus coupled with said battery replacing apparatus.

8. In a system for conveying a coiler can between a sliver producing fiber processing machine and a sliver consuming fiber processing machine, including a carriage for accommodating the coiler can;

an electric motor mounted on said carriage for propelling said carriage; and a battery replaceably mounted on said carriage and being electrically connected with said motor for supplying electric current thereto;

the improvement comprising (a) a battery replacing apparatus including (1) manipulating means for removing a battery from and for moving a battery onto said carriage and (2) support means for supporting the battery during displacement thereof by said manipulating means;

(b) a battery charging apparatus coupled with said battery replacing apparatus and including (1) a current supply element; and (2) a battery stand for supporting a battery during charging thereof;

(c) a current rail mounted on the battery; and (d) a current pickup element mounted on the carriage and being electrically connected with the electric motor; said current pickup element entering into engagement with said current rail upon positioning the battery on said carriage, and said current supply element entering into engagement with said current rail upon positioning the battery on said battery stand.

9. The system as defined in claim 8, wherein said current pickup element is a contact member.

10. The system as defined in claim 8, wherein said current supply element is a contact member.

11. The system as defined in claim 8, wherein said current pickup element and said current supply element are of identical construction.

12. The system as defined in claim 8, further comprising a run-on ramp adjoining an end of said current rail.

13. The system as defined in claim 8, further comprising means for resiliently supporting said current pickup element.

14. The system as defined in claim 8, further comprising means for resiliently supporting said current supply element.

15. The system as defined in claim 8, further comprising a microcomputer mounted on said carriage and coupled to said battery to indicate a state of charge of said battery.

16. In a system for conveying a coiler can between a sliver producing fiber processing machine and a sliver consuming fiber processing machine, including a carriage for accommodating the coiler can;

an electric motor mounted on said carriage for propelling said carriage; and a battery replaceably mounted on said carriage and being electrically connected with said motor for supplying electric current thereto;

the improvement comprising a battery replacing apparatus including (a) a displaceable cart;

(b) manipulating means, mounted on the cart, for removing a battery from and for moving a battery onto said carriage;

(c) support means, mounted on the cart, for supporting the battery during displacement thereof by said manipulating means;

(d) track means for providing for a generally linear displacement of said manipulating means relative to said cart; and (e) a rotary platform mounted on said cart; said track means being mounted on said rotary platform.

* * * * *